United States Patent [19]

Ohtani

[11] Patent Number: 4,839,696

[45] Date of Patent: Jun. 13, 1989

[54] IMAGE RECORDING APPARATUS FOR RECORDING A SELECTED PORTION OF AN ORIGINAL IMAGE

[75] Inventor: Kazuo Ohtani, Kawasaki, Japan

[73] Assignee: Canon Kabushiki Kaisha, Tokyo, Japan

[21] Appl. No.: 17,578

[22] Filed: Feb. 24, 1987

[30] Foreign Application Priority Data

Feb. 28, 1986 [JP] Japan ..... 61-043032
Jul. 1, 1986 [JP] Japan ..... 61-152672

[51] Int. Cl.[4] ..... G03G 15/00

[52] U.S. Cl. ..... 355/218; 355/214; 355/246; 355/208

[58] Field of Search ..... 355/3 R, 5, 7, 14 T, 355/40, 43, 45, 71, 14 R, 14 C

[56] References Cited

U.S. PATENT DOCUMENTS 3,907,418 9/1975 Okuyama ..... 355/54
3,912,387 10/1975 Brooke ..... 355/3 R
4,695,155 9/1987 Ishii et al. ..... 355/7 X
4,708,464 11/1987 Otsuki et al. ..... 355/7 X
4,739,368 4/1988 Lachut et al. ..... 355/7 X

FOREIGN PATENT DOCUMENTS 58-223143 12/1983 Japan ..... 355/71
59-216133 12/1984 Japan ..... 355/14 SH
60-239722 11/1985 Japan ..... 355/14 C

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

An image recording apparatus includes photosensors for detecting an image region of an original, an exposure section for forming an image on a photosensitive drum, a mode selection switch for selecting, as an image forming range, one of a portion inside the image region and a portion including an inside and outside the image region, and a microcomputer for controlling the exposure section in accordance with the outputs from the photosensors and the mode selection switch.

17 Claims, 13 Drawing Sheets

FIG. 9
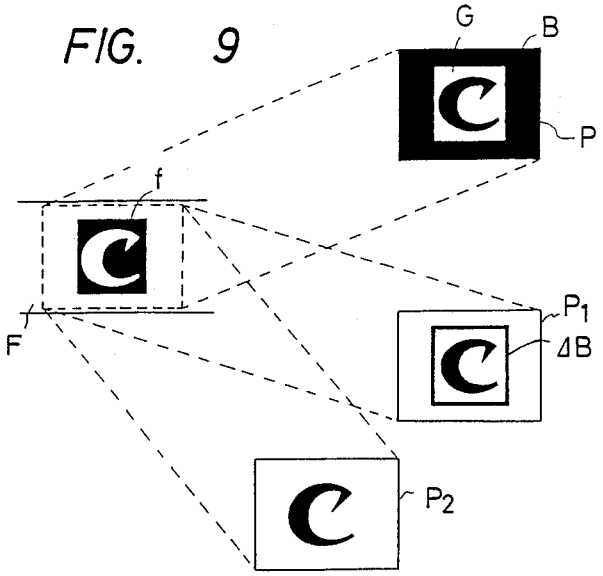
FIG. 10
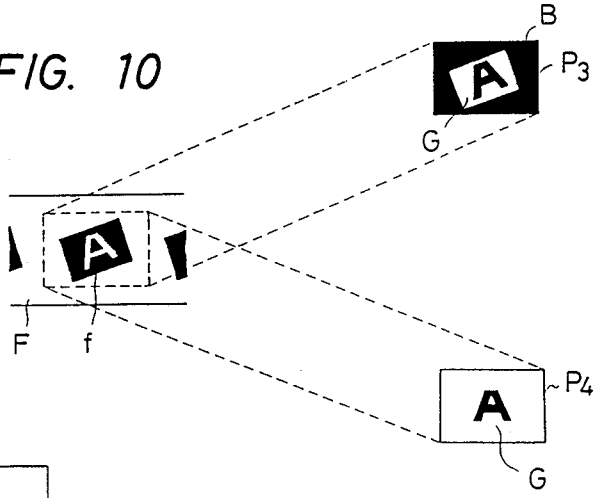
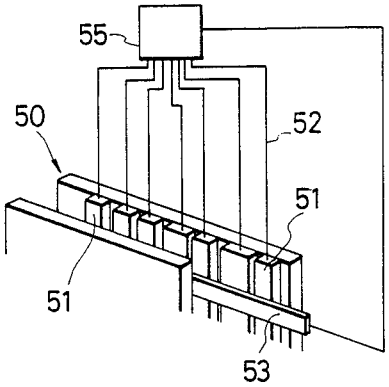
FIG. 11

IMAGE RECORDING APPARATUS FOR RECORDING A SELECTED PORTION OF AN ORIGINAL IMAGE

BACKGROUND OF THE INVENTION

1. Field of the Invention

The present invention relates to an image recording apparatus for recording an image on an original, such as a microfilm.

2. Related Background Art

The following image recording apparatus has been conventionally proposed. More specifically, in a microfilm having a negative image, the negative image is recorded in a frame f of a microfilm F, and a peripheral portion of each frame f is transparent, as shown in FIG. 9. When a positive image of the microfilm F is printed out using an image recording apparatus for inverting a negative to positive image, the transparent peripheral portion of the frame f is developed. As a result, an unnecessary black frame B is printed on a transfer material P around an image region G, as shown in Fig. 9. This results in a poor appearance and an increase in toner consumption.

In order to solve the above problem, an image recording apparatus wherein the image region of the image from f of the microfilm F is detected, and a recording operation onto the transfer material P is performed with reference to a region determined based on the image region, has been proposed.

However, since such a control operation has a restriction in arrangement density of sensors for detecting the image region of the frame f, a satisfactory resolution of image detection cannot be obtained, and the following problem is posed.

More specifically, in order to completely eliminate the occasion of the unnecessary black frame B, the reference region is reduced to be smaller than an actual image region, in one conventional apparatus. In this case, if an image is present around the image frame f of the microfilm F, this image is omitted and cannot be recorded on a transfer material P2. In order to prevent an image from being omitted, the reference region is set to be wider than an actual image region in another conventional apparatus. In this case, a black frame ΔB is undesirably printed around an image region G of a transfer material P1 although it has a small width, as shown in FIG. 9.

Conventionally, as shown in FIG. 10, a negative image is recorded in the frame f of the microfilm F, and the frame f of the microfilm F which is imaged by a rotary camera is often inclined from a proper posture. When the microfilm F shown in FIG. 10 is printed out using a microfilm printer, an image G is obliquely recorded on a transfer material P3 in the same manner as the image on the microfilm F. As shown in FIG. 10, since the peripheral portion of the frame f of the microfilm F is transparent, an unnecessary black frame B is printed around an image region G on the transfer material P3. Such a printed image is not easy to see, has poor appearance, and consumes a large amount of toner, resulting in an increase in printing cost.

SUMMARY OF THE INVENTION

The present invention has been made in consideration of the above situation, and has as its object to provide an image recording apparatus free from the conventional problems.

It is another object of the present invention to provide an image recording apparatus which can obtain a properly recorded image corresponding to an original image.

It is still another object of the present invention to provide an image recording apparatus with which a user can select whether the image region of an original is entirely recorded even if a black frame remains or a partial recording operation is performed while formation of the black frame is completely prevented.

It is still another object of the present invention to provide an image recording apparatus which can detect an image region, correct an inclination of an image, and control a region on which an image is to be recorded, thereby obtaining a good copied image which is not inclined and thereby saving toner consumption.

These objects are attained by the present invention wherein, in one aspect, there is provided an apparatus including photosensors for detecting an image region of an original. An exposure section forms an image on a photosensitive drum, and a mode selection switch permits selecting between a portion inside the image region and a portion including areas inside and outside the image region. A microcomputer is then utilized for controlling the exposure section in accordance with the outputs form the photosensors and the mode selection switch.

BRIEF DESCRIPTION OF THE DRAWINGS

FIGS. 9 and 10 are illustrations for explaining an image on a microfilm and a printed image;

FIG. 11 is a perspective view showing main part of a liquid-crystal shutter;

DETAILED DESCRIPTION OF THE PREFERRED EMBODIMENTS

An embodiment of the present invention will now be described taken in conjunction with the accompanying drawings.

Figure 1:
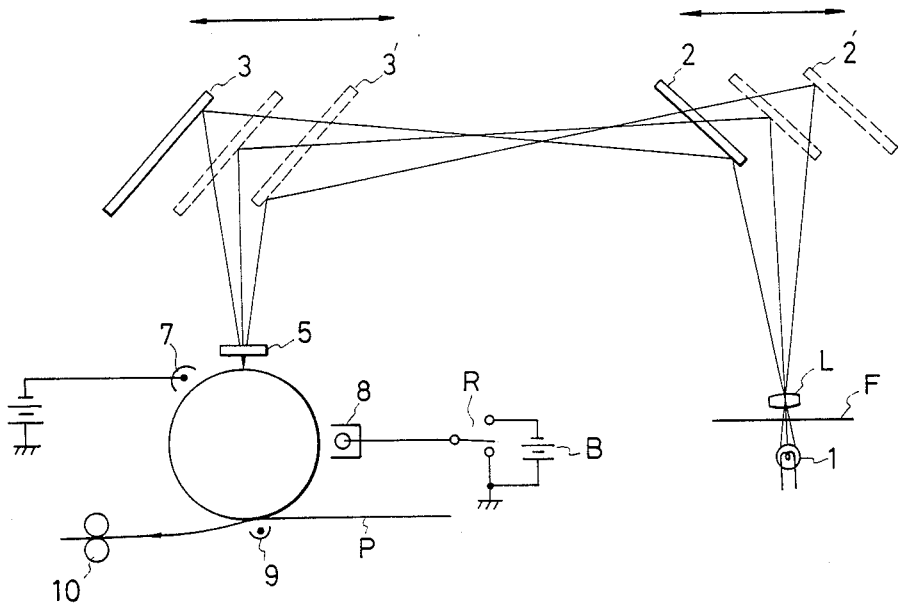
FIG. 1 is a schematic view showing an image recording apparatus according to an embodiment of the present invention.

FIG. 1 shows a microfilm printer as an embodiment of an image recording apparatus according to the present invention. Referring to FIG. 1, the microfilm printer includes a microfilm F as an original, a projection lamp 1, a projection lens L, scan mirrors 2 and 3 disposed to form 90°, a photosensitive drum 4 as an image recording medium, a shutter base 5 which is arranged above the photosensitive drum 4 and has a slit 6 (FIG. 3) along its axial direction, a primary charger 7, a developer 8 for performing a developing operation by an inversion developing method, a transfer charger 9, and a fixing device 10. The scan mirrors 2 and 3 integrally reciprocate between solid-line positions and broken-line positions 2′ and 3″ at a speed ½ the peripheral velocity of the photosensitive drum 4.

Figure 2:
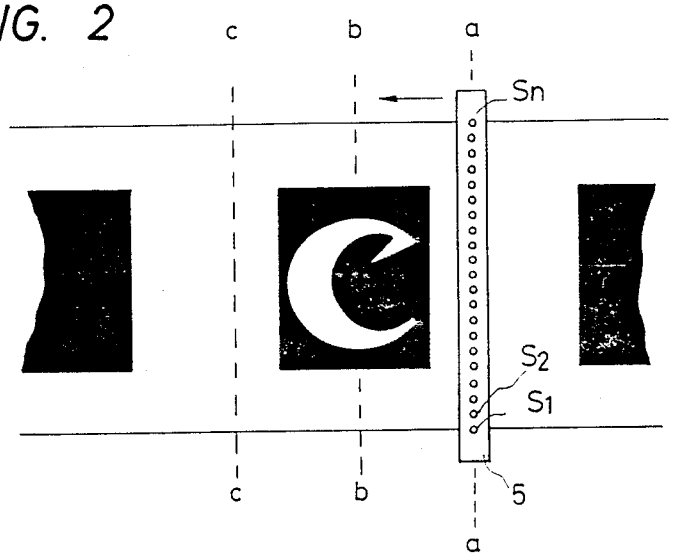
FIG. 2 is an illustration for explaining a scan state of a photosensor.

An image on the microfilm F is sequentially scanned and exposed on the photosensitive drum 4 in the order of a line a—a, a line b—b, and a line c—c of the microfilm F, as shown in FIG. 2, by moving the scan mirrors 2 and 3 in the directions indicated by arrows. An image is recorded on a transfer material P by a known electrophotography technique.

Figure 3:
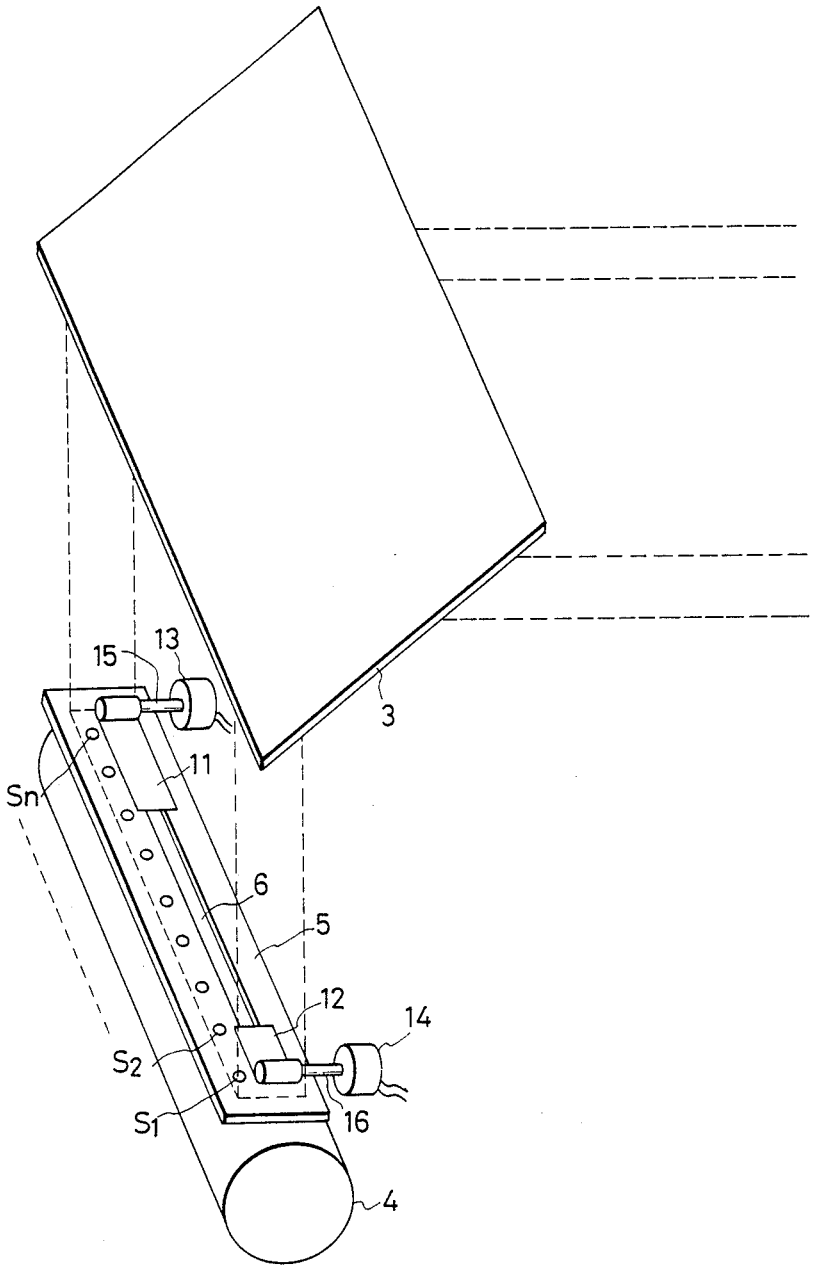
FIG. 3 is a perspective view showing main part of FIG. 1.

The slit 6 is formed on the shutter base 5 along the axial direction of the photosensitive drum 4, as shown in FIG. 3, and a pair of shutter plates 11 and 12 for controlling an exposure range in the axial direction of the photosensitive drum 4 by changing an opening width of the slit 6 are arranged thereon. The shutter plates 11 and 12 each have a nontransparent film shape, and are wound around drive shafts 15 and 16 of pulse motors 13 and 14 to be rewindable. The shutter plates 11 and 12 are rewound upon rotation of the pulse motors 13 and 14, so as to change the opening width of the slit 6 from the two end sides. Photosensors Sl to Sn using amorphous silicon and the like are disposed on the shutter base 5 at equal intervals.

Figure 5:
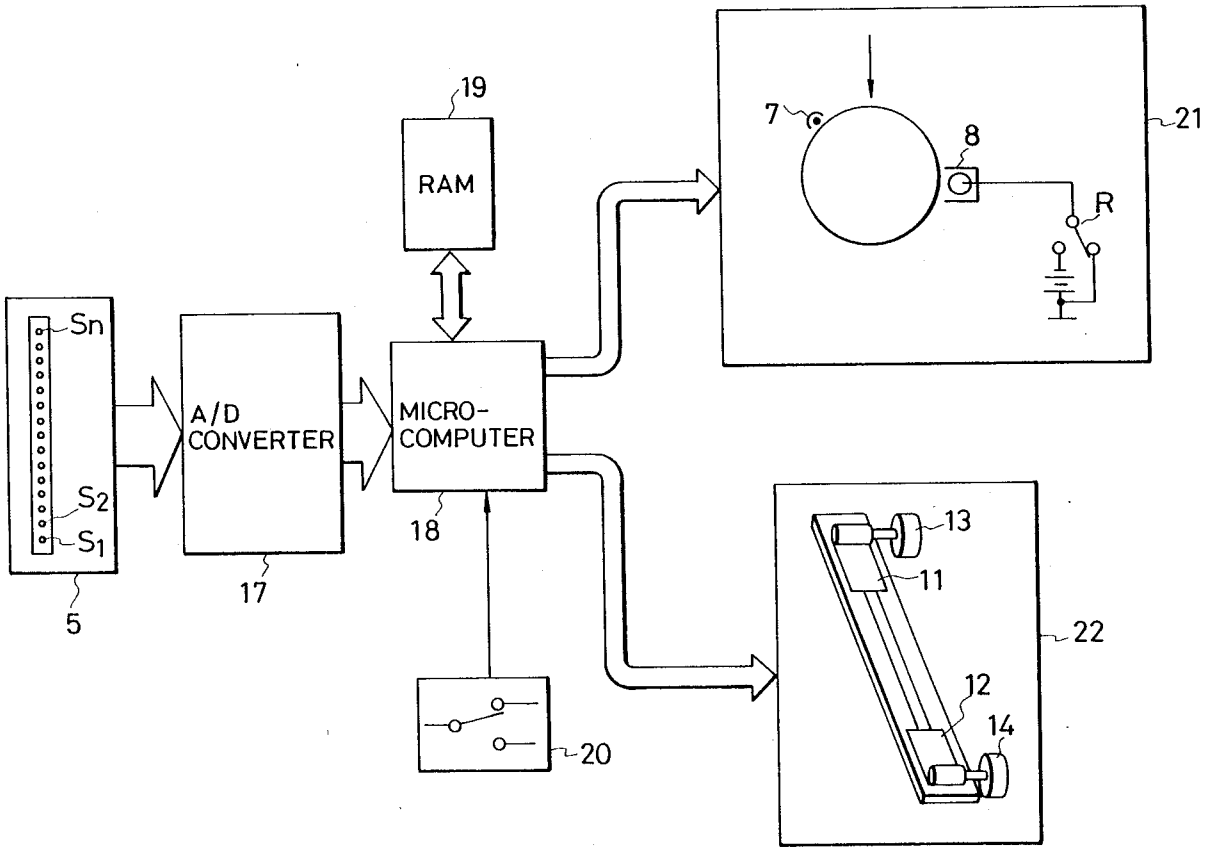
FIG. 5 is a block diagram showing a control system.

FIG. 5 is a block diagram showing a control system of the microfilm printer. In FIG. 5, the control system includes the photosensors Sl to Sn, and A/D converter 17, a microcomputer 18 as a control means, a RAM 19, a mode selection switch 20 as a setting means, an image forming section 21 for controlling image forming conditions of the developer 8, the primary charger 7, and the like, and an exposure section 22 for controlling the opening width of the slit 6.

In the recording apparatus according to this embodiment having the above arrangement, an image recording operation is performed as follows. More specifically, prior to image exposure onto the photosensitive drum 4, the scan mirrors 2 and 3 are pre-scanned from their home positions, so that an image on the microfilm F is scanned and exposed on the shutter base 5.

Figure 4:
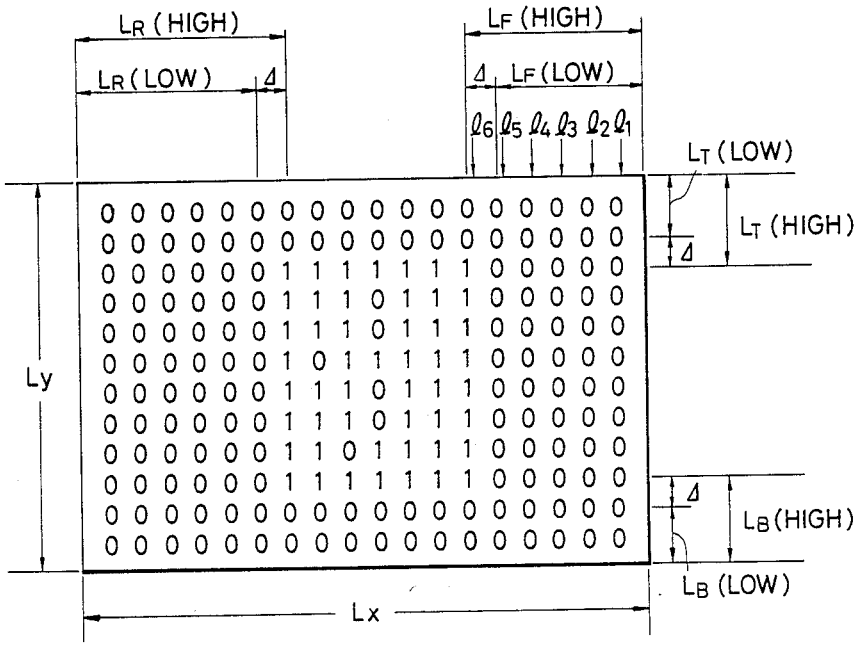
FIG. 4 is an illustration for explaining image illuminance data.

During pre-scan operation, image illuminance data detected by the photosensors Sl to Sn is converted to digital data by the A/D converter 17, and is then supplied to the microcomputer 18. The microcomputer 18 binarizes the data using a predetermined threshold level (to be referred to as a slice level hereinafter), and stores it in the RAM 19. More specifically, the illuminance distribution of the image is divided with reference to a predetermined time interval in a feed direction of the microfilm and with an arrangement interval of the photosensors Sl to Sn in the direction perpendicular to the feed direction. Image illuminance data which is higher than the slice level is given as "0" and data which is lower than the slice level is given as "1", and these data are sequentially stored in the RAM 19. FIG. 4 shows the content of the RAM 19 when the pre-scan operation is completed. In FIG. 4, $L_X$ and $L_Y$ respectively correspond to the transverse and longitudinal dimensions of the transfer sheet P.

In this embodiment, prior to the image recording operation, a user selects, using the mode selection switch 20, whether a black frame B formed around an image region is completely removed or the entire image is printed without omission. More specifically, when the frame B is completely removed, the mode selection switch 20 is switched to "High". On the other hand, when the image is entirely printed out without omission, the mode selection switch 20 is switched to "Low".

When the mode selection switch 20 is switched to "High", the microcomputer 18 determines the frame mode "High". When the switch 20 is switched to "Low", the microcomputer 18 determines the frame mode "Low".

Figure 6:
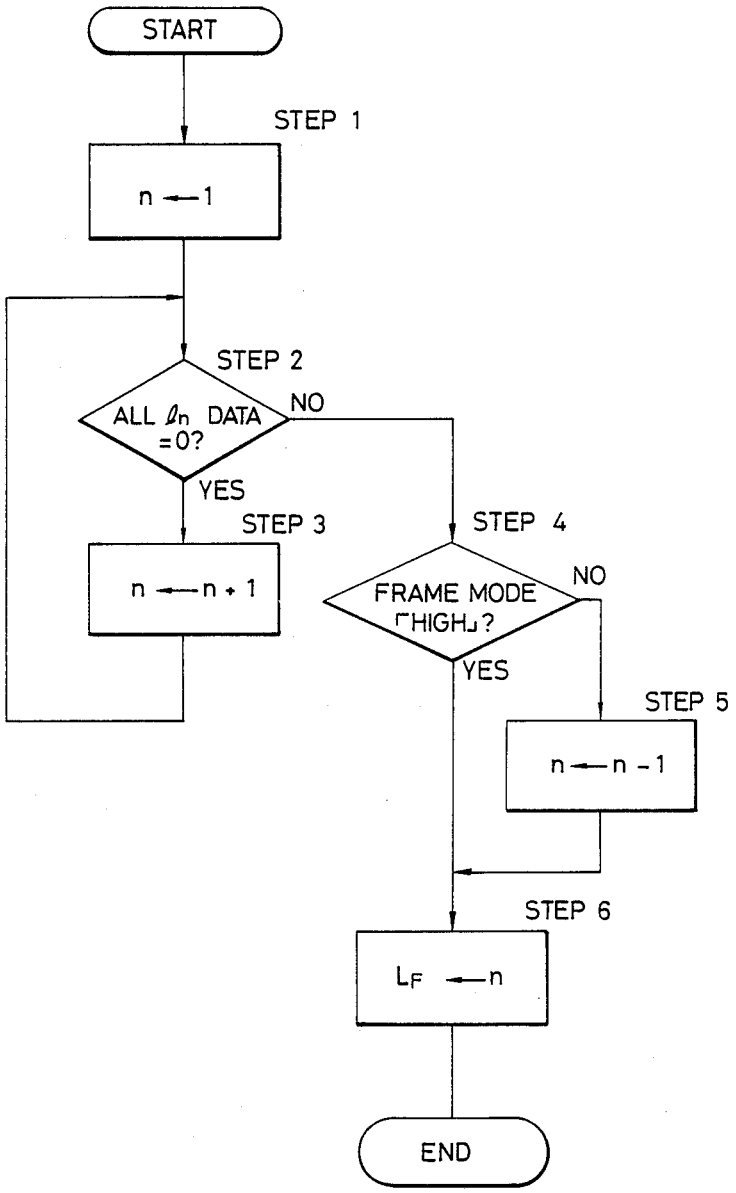
FIG. 6 is a flow chart showing the operation of the control system shown in FIG. 5.
Figure 19:
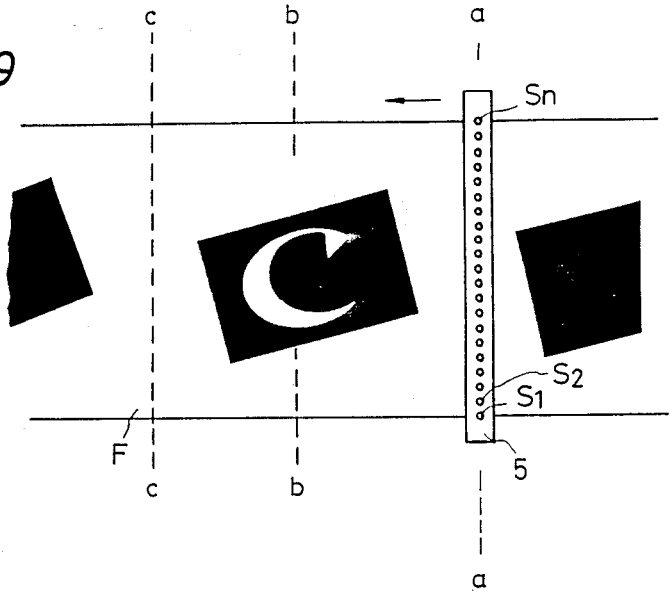
FIG. 19 is a view showing a scan state of a photosensor.

The microcomputer 18 discriminates, from a bit array l1 of the image illuminance data stored in the RAM 5 shown in FIG. 19, whether the bit array includes all "0" data or includes "1" data (steps 1 and 2 in FIG. 6.) If the bit array includes all "0"data, the discrimination is repeated for bit arrays l1, l2, l3, . . . (steps 3 and 2). When the first array ln including data "1"is detected (l6 in FIG. 6), the microcomputer 18 detects the state of the mode selection switch 20 (step 4). If the frame mode is "High", the microcomputer 18 adopts n, and when the frame mode is "Low", adopts n-1 (step 5), as a value $L_F$ of the image recording region (step 6). The microcomputer 18 similarly performs the above operation for the left end and upper and lower ends, and determines a region on which the image is recorded, i.e., the image recording region. In FIG. 4, if both vertical and horizontal pitches of the image illuminance data are given as Δ, values $L_F$, $L_R$, $L_B$, and $L_T$ are increased only by +Δ in the case of frame mode "High" and are not increased in the case of the frame mode "Low".

The microcomputer 18 controls a developing operation by opening/closing a relay R shown in FIG. 5, so as to turn on/off a developing bias B, based on the image recording region data, in the feed direction of the microfilm, i.e., the rotating direction of the photosensitive drum 4. The microcomputer 18 controls the opening width of the slit 6 by driving the pulse motors 13 and 14 shown in FIG. 5 so as to wind or rewind the shutter plates 11 and 12, in the direction perpendicular to the feed direction of the microfilm, i.e., the axial direction of the photosensitive drum 4. In this state, the scan mirrors 2 and 3 are scanned to expose light reflected by the microfilm onto the photosensitive drum 4, and the relay R is appropriately turned on or off, thereby recording an image on the transfer material P. As a result, when the printing operation is performed in the frame mode "High", a resultant print shown in a transfer material P2 of FIG. 9 is obtained. When the printing operation is performed in the frame mode "Low", a print shown in a transfer material P1 of FIG. 9 is obtained. More specifically, when the frame mode "High" is selected, only a first area inside the image recording region is printed. When the frame mode "Low" is selected, only a first including an inside and outside of the image region is printed.

In this embodiment, the user can select whether the black frame B around the image region is completely removed or an image is entirely printed without omission. For this reason, undesirable formation of the black frame which causes a poor appearance can be prevented, and a peripheral portion of an image can be printed from being omitted. When the frame mode "High" is selected, an image around the image region may be omitted. However, since no image is normally present around the image region, this does not pose a serious problem. Therefore, the user normally prints in the frame mode "High", and can select the frame mode "Low" only when the image is present around the image region. Therefore, a good print can always be obtained.

In the above embodiment, the two frame modes "High" and "Low" are set. However, three or more frame modes can be provided, and an adjusting range for each mode can be desirably set.

Figure 7:
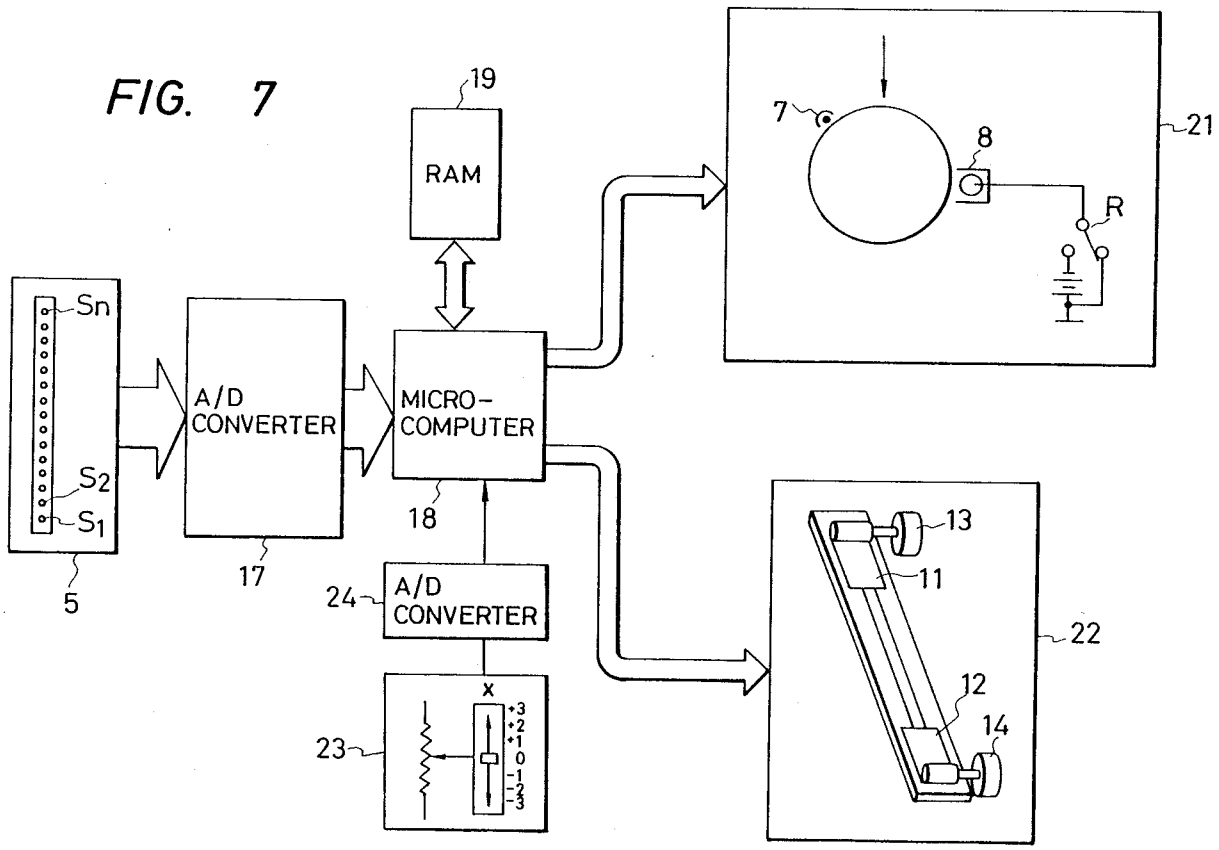
FIG. 7 is a block diagram showing a control system according to another embodiment of the present invention.
Figure 8:
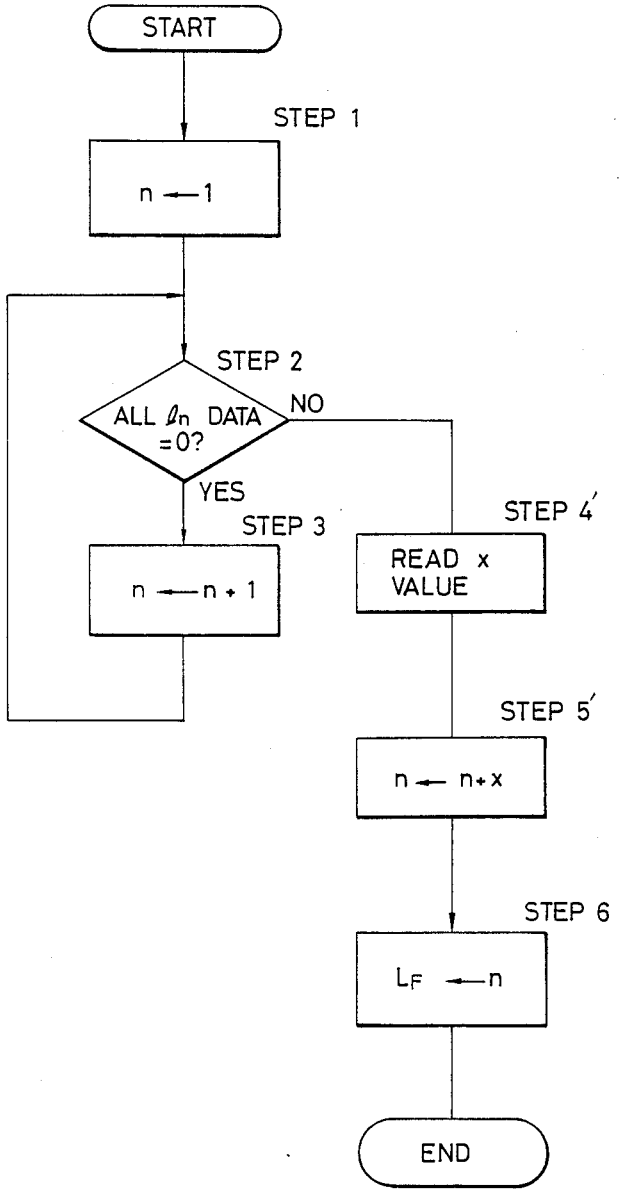
FIG. 8 is a flow chart showing the operation of the control system shown in FIG. 7.

FIGS. 7 and 8 show another embodiment of the present invention, and the same reference numerals in this embodiment denote the same parts as in the previous embodiment. In this embodiment, a setting means comprises a control (variable resistor) 23, and the control 23 is connected to a microcomputer 18 through an A/D converter 24. When the control 23 is operated, a range in a frame to be recorded can be continuously set over a wide range, as shown in steps 4' and 5' in FIG. 8. The other arrangements and the operation are the same as those in the above embodiment, and a detailed description thereof will be omitted. When a value X of the control 23 is decreased in a "−" direction, a range of a film to be recorded is increased, and if the value X is increased in the "+" direction, the range of the film to be recorded is decreased.

In the above embodiments, the image exposure range in the axial direction of the photosensitive drum 4 is changed by moving the shutter plates, but can be changed by a liquid-crystal shutter.

FIG. 11 shows a liquid-crystal shutter. In a liquid-crystal shutter 50, light-transmission segment electrodes 51 are arranged along the axial direction of the photosensitive drum 4 at an equal pitch, and lead wires 52 are connected to the respective segment electrodes. A light-transmission electrode 53 which extends in the axial direction of the photosensitive drum 4 faces the segment electrodes to interpose a liquid-crystal film therebetween. When a voltage is simultaneously applied to the segment electrode selected by a liquid-crystal driver 55 and to the electrode 53, the selected portion of the liquid-crystal shutter allows light to transmit therethrough, and other portions do not allow light transmission. When the segment electrodes to which a voltage is to be applied are selected, the exposure range of the photosensitive drum 4 can be controlled. The electrodes 51 and 53 are interposed between transparent glass substrates 56 and 57. The electrodes 51 and 52 comprise transparent conductive films, such as $In_2O_3$, films, $SnO_2$ films, and the like. As a liquid-crystal material, a nematic or cholesteric liquid-crystal material or a mixture thereof is used.

In the above embodiments, an image recording range in the circumferential direction of the photosensitive drum 4 is determined by turning on or off the developing bias B. The present invention is not limited to this. For example, the image recording range can be determined by opening/closing a shutter using the entire slit, by turning on/off the primary charger, or by approaching/separating the developer to or form the photosensitive drum.

In the above embodiment, the microfilm has a negative image. The present invention can be applied to a case wherein a microfilm has a positive image. When a positive image is obtained from an original positive image, light can be uniformly radiated on a portion of a photosensitive drum at which toner attachment is to be prevented.

In the above embodiment, an image is exposed on the photosensitive drum to record it. The present invention can be applied to a case wherein an image on a microfilm is read by a CCD or the like, and an image is recorded on an optical disk or the like.

With the above embodiments, the user can select whether an image region of an original is entirely recorded even if a thin black frame portion remains or formation of a black frame is completely prevented even if an image may be partially omitted. Therefore, appearance of a recorded image will not be impaired, and an image can be prevented from undesirable omission.

Figure 12:
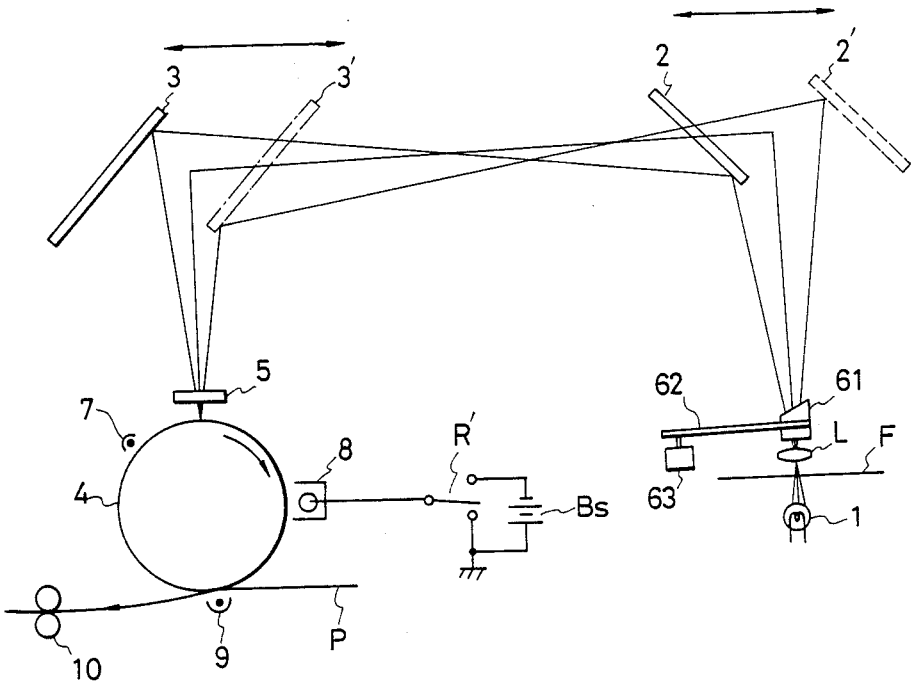
FIG. 12 is a schematic view of a microfilm printer according to still another embodiment of the present invention.
Figure 13:
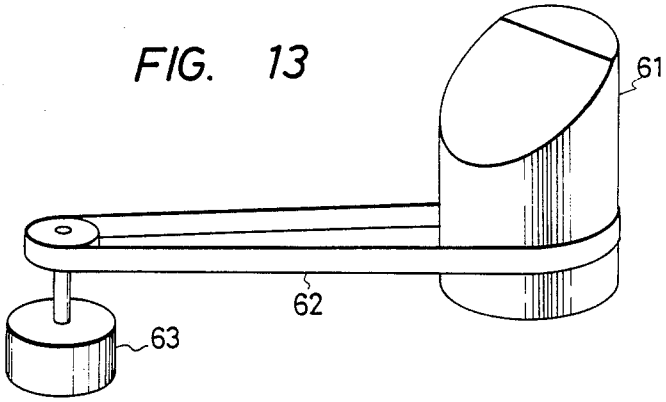
FIG. 13 is a perspective view showing a drive system for a prism in the embodiment shown in FIG. 12.

FIG. 12 shows a microfilm printer according to still another embodiment of the present invention. The same reference numerals in this embodiment denote the same parts as in the above embodiments. In FIG. 12, a prism 61 is adopted as a correction means for correcting an inclination of a projection image. The prism 61 is pivotal about a shaft parallel to the optical axis of a projection lens L. The prism 61 is coupled to a pulse motor 63 through a belt 62, as shown in FIG. 13. When the pulse motor 63 is driven, the prism 61 is pivoted through the belt 62, and an inclination of an image on a microfilm F, projected onto the photosensitive drum 4, can be corrected to a proper posture.

Figure 14:
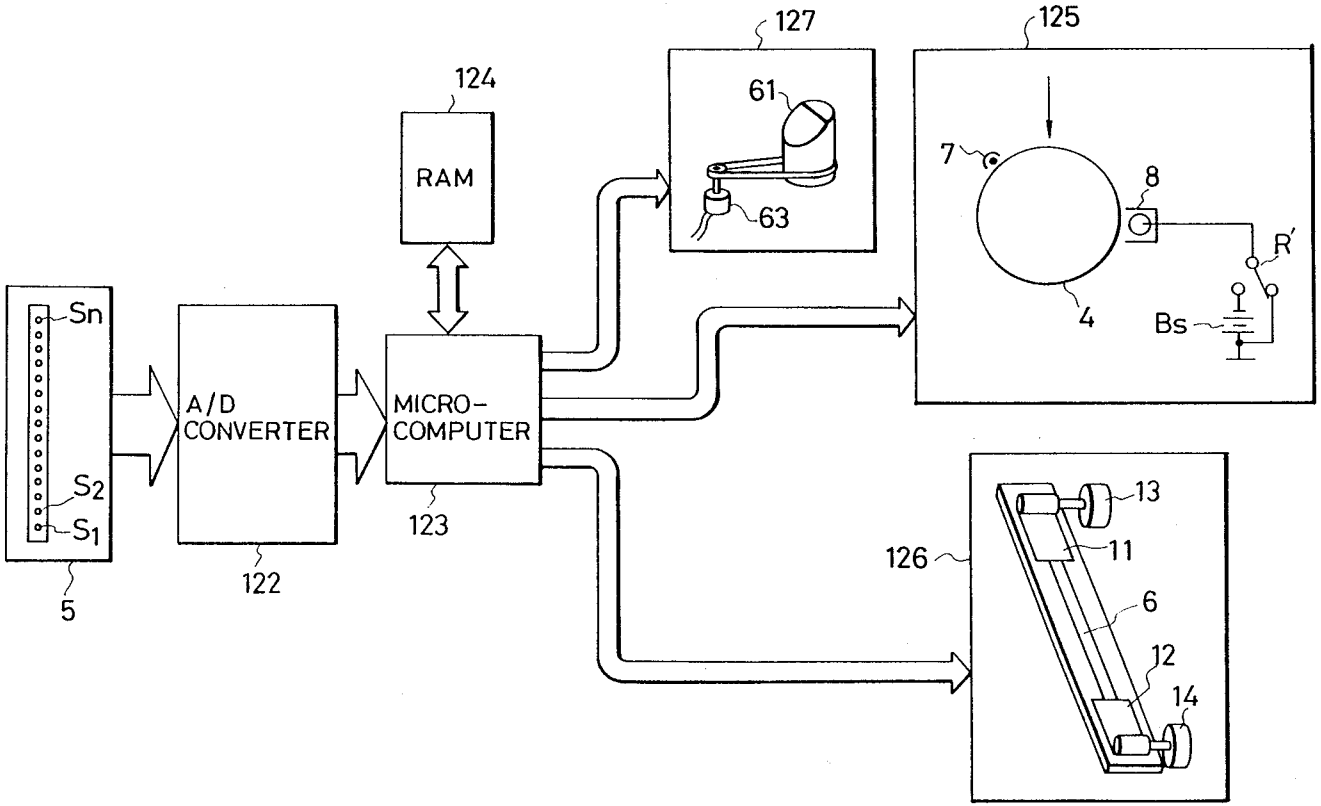
FIG. 14 is a block diagram showing a control system.

FIG. 14 is a block diagram showing a control system of the microfilm printer shown in FIG. 12. The control system shown in FIG. 14 includes an A/D converter 122, a microcomputer 123 as a control means, a RAM 124, a correcting section 127 for correcting an inclination of the image on the microfilm F, an image forming section 125 for controlling the image forming conditions of the developer 8, the primary charger 7, and the like, and an exposure section 126 for controlling the opening width of the slit 6.

Figure 15:
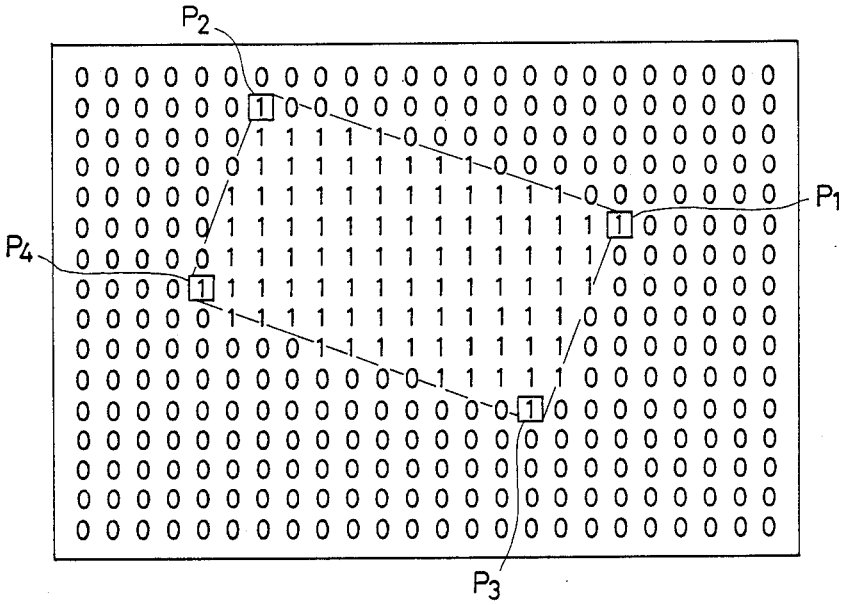
FIG. 15 is an illustration showing image illuminance data.

In the image recording apparatus of this embodiment having the above arrangement, the scan mirrors 2 and 3 are pre-scanned prior to image exposure onto the photosensitive drum 4, so that an image on the microfilm F is scanned and exposed onto the photosensors Sl to Sn on the shutter base 5, as shown in FIG. 19. During the pre-scan operation, image illuminance data detected by the photosensors Sl to Sn is converted to digital data by the A/D converter 122, and is supplied to the microcomputer 123. The microcomputer 123 binarizes the data using a predetermined threshold level (to be referred to as a slice level hereinafter), and stores it in the RAM 124. More specifically, the illuminance distribution of the image is divided in accordance with a predetermined time interval in a direction perpendicular to the axis of the photosensitive drum 4, and with the arrangement interval of the photosensors Sl to Sn in the direction along the axial direction of the photosensitive drum 4. Image illuminance data which is higher than the slice level is given as "0" and data which is lower than the slice level is given as "1", and these data are sequentially stored in the RAM 124. FIG. 15 shows the content of the RAM 124 when the pre-scan operation is completed.

Figure 18:
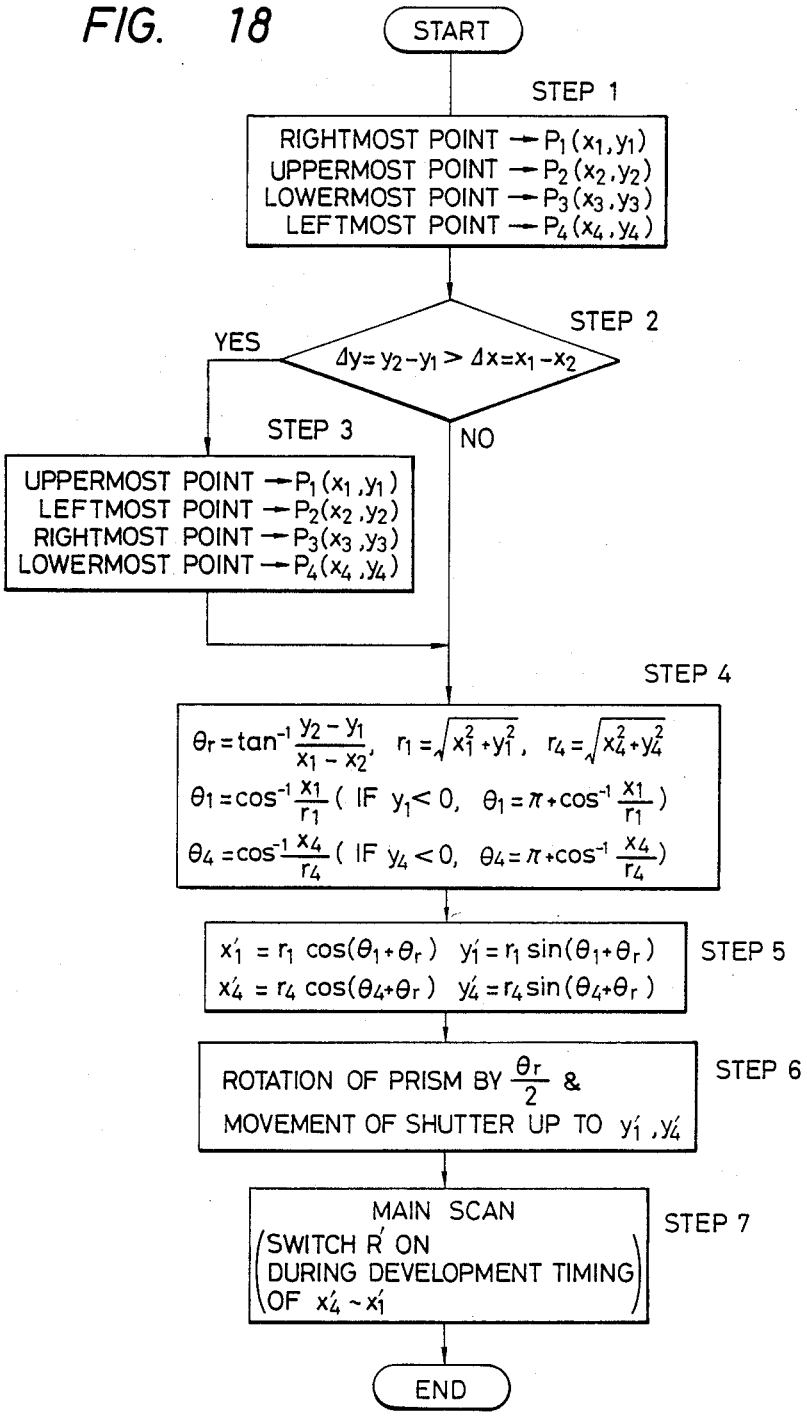
FIG. 18 is a flow chart showing the operation of the control system shown in FIG. 14.

In this embodiment, an inclination of an image and a range for recording an image are obtained as follows. As shown in FIG. 18, the microcomputer 123 looks up the RAM 124 in step 1, and gives a rightmost point of an image on the X-Y coordinate system as P1 (x1, y1), an uppermost point as P2 (x2, y2), a lowermost point as P3 (x3, y3), and a leftmost point as P4 (x4, y4). In this case, xn and yn are coordinates in a system in which the center Q of the entire transfer sheet P serves as the origin, and a right direction represents a positive direction of x and an upward direction represents a positive direction of y, as shown in FIG. 16.

In step 2, the microcomputer 123 calculates $\Delta x = x_1 - x_2$ and $\Delta y = y_2 - y_1$. If $\Delta y > \Delta x$, the microcomputer 123 again looks up the content of the RAM 124, and replaces "Pn"s, "xn"s, and "yn"s such that the uppermost point is given as P1 (x1, y1), the leftmost point is given as P2 (x2, y2), the rightmost point is given P3 (x3, y3), and the lowermost point is given as P4 (x4, y4). This illustrates a case wherein the image is inclined in a direction opposite to a case shown in FIGS. 15 and 16. Fig. 17 shows the positions of the respective points after replacement. If $\Delta y \leqq \Delta x$ in step 2, the above replacement is not executed.

Figure 16:
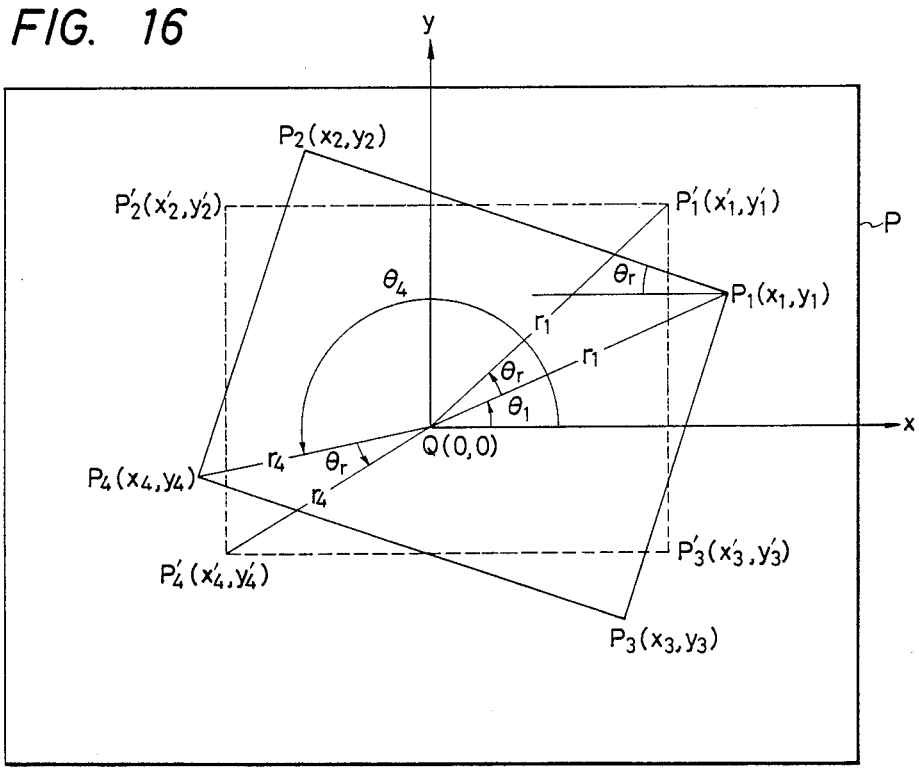
FIGS. 16 and 17 are views for explaining an inclination correction of an image.
Figure 17:
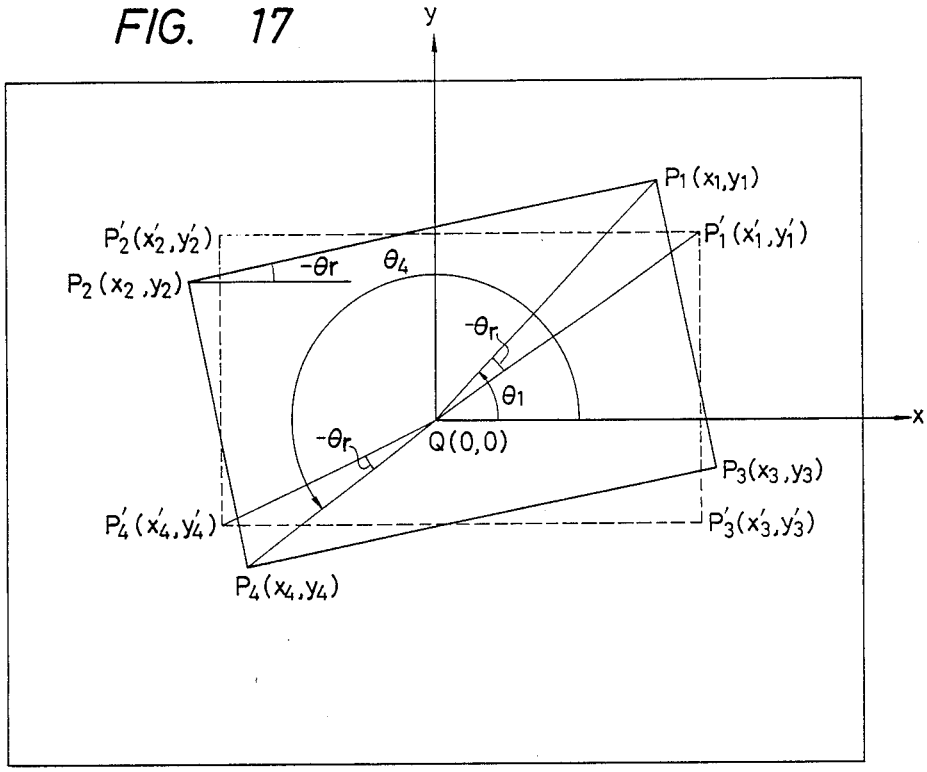

In step 4, $\theta r$, r1, r4 $\theta 1$, and $\theta 4$ in FIG. 16 or 17 are calculated. More specifically, $r1 = \sqrt{x1^2 + y1^2}$, $\theta r = \tan^{-1}(y2 - y1)/(x1 - x2)$, $\theta 1 = \cos^{-1}(x1/r1)$ (if $y1 < 0$, $\theta 1 = \pi + \cos^{-1}(x1/r1)$, $r4 = \sqrt{x4^2 + y4^2}$, and $\theta 4 = \cos^{-1}(i\ x4/r4)$ (if $y4 < 0$, $\theta 4 = \pi + \cos^{-1}(x4/r4)$. Where $\theta r$ and $\theta l$ are angles if the direction of arrow in FIGS. 16 and 17 is a positive direction, and can take negative values. $\theta r$ is an inclination of an image to be corrected.

Thereafter, in step 5, the positions of upper, lower, left and right sides after $\theta r$ is corrected, more specifically, x1', y1', x4', and y4' in FIGS. 16 and 17 are calculated using the following equations. That is, $x1' = r1\cos(\theta 1 + \theta r)$, $y1' = r1\sin(\theta 1 + \theta r)$, $x4' = r4\cos(\theta 4 + \theta r)$, and $y4' = r4\sin(\theta 4 + \theta r)$.

In step 6, the pulse motor 63 shown in FIG. 12 is rotated so that the prism 61 is rotated by $\theta r/2$. An image projected onto the photosensitive drum 4 is rotated by an angle twice the rotating angle of the prism 61. Therefore, the inclination $\theta r$ of the image can be corrected. At the same time, the pulse motors 13 and 14 are driven so as to draw out the shutter plates 11 and 12 to positions corresponding to y1' and y4' on the image. Thereafter, in step 7, the image recording operation (main scan) is performed. At this time, a switch R' shown in FIG. 12 is turned on to apply the developing bias Bs to a portion of the photosensitive drum 4 which is subjected to exposure of the region surrounded by points x4' to x1' on the image, only while this portion faces the developer 8 shown in FIG. 12, thereby developing this exposure portion.

In this manner, the inclination of the image is corrected, and a black frame surrounding the inclination-corrected image, i.e., a region outside P1', P2', P3', and P4' in FIGS. 16 and 17, can be converted to a white region by limiting the exposure region using the shutter plates 11 and 12 in the axial direction of the photosensitive drum 4 and by controlling the developing bias Bs in the direction perpendicular to the axis of the photosensitive drum 4. In this manner, a print image G can be recorded from the frame f of the microfilm F shown in FIG. 10 onto a transfer material P4 in a proper posture.

In the above embodiment, the prism 61 is rotated to correct the inclination of the image. This correction can be made by rotating the microfilm F itself. In this case, rotating correction is made using the rotating angle not $\theta/2$ but $\theta$.

In the above embodiment, a case has been described wherein the microfilm F has a negative image. The present invention can be applied to a case wherein a microfilm has a positive image.

In the above embodiment, an image is exposed onto a photosensitive drum to record the image. The present invention can be applied to a case wherein an image on a microfilm is read by a CCD or the like, and an image is recorded on an optical disk or the like.

In this manner, the apparatus of the above embodiment comprises a detection means for detecting an image region of a microfilm F, a correction means for correcting an inclination of an image based on the detection result of the detection means, and control means for calculating an image position after the inclination is corrected by the correction means and controlling a region for recording an image based on this result. Therefore, even when an image on an original is inclined and a region causing a black frame on a transfer sheet is present around an image, a good copied image which is easy to see and can reduce a toner consumption can be obtained.

What is claimed is:

1. An image recording apparatus comprising:

detection means for detecting an image region of an original;

recording means for recording an image of the original onto a recording medium;

setting means for setting a range of the original to be recorded on said recording medium, said setting means being selectively set to a first mode for recording a first area inside the image region detected by said detection means and a second mode for recording a second area including a portion outside the image region and larger than said first area; and recording control means for controlling said recording means based on an output from said detection means and said setting means.

2. An apparatus according to claim 1, wherein said detection means has a plurality of light-receiving elements for receiving light from the original, and means for discriminating the image region and non-image region of the original based on outputs from said light-receiving elements.

3. An apparatus according to claim 1, wherein said recording means has charge means for uniformly charging a photosensitive body, exposure means for projecting light from the original onto said photosensitive body to form an electrostatic latent image corresponding to the original, and developing means for developing the latent image with toner.

4. An apparatus according to claim 3, wherein said recording control means has shutter means for shielding light passing through a selected optical path of exposure optical paths to said photosensitive body, and means for controlling a range shielded by said shutter means in accordance with the outputs from said detection means and said setting means.

5. An apparatus according to claim 1, wherein said setting means can set an arbitrary area between said first and second areas as a recording range.

6. An image recording apparatus having charge means for uniformly charging a photosensitive body, exposure means for projecting light corresponding to an optical image of an original onto the charged photosensitive body to form an electrostatic latent image, and developing means for developing the latent image with toner, comprising:

detection means for detecting an image region of an original;

setting means for selectively setting a first mode for recording a first area of the original and a second mode for recording a second area of the original which is larger than the first area; and means for receiving an output from said detection means and an output from said setting means to prevent, when the first mode is set, toner attachment to a portion of said photosensitive body corresponding to a portion outside of the image region detected by said detection means and to prevent, when the second mode is set, toner attachment to a portion of said photosensitive body corresponding to a predetermined region outside of the larger than said image region detected by said detection means.

7. An image recording apparats comprising:

detection means for detecting an image region of an original;

correction means for correcting an inclination of an image to a proper state based on the output from said detection means;

charge means for uniformly charging a photosensitive body;

exposure means for projecting light form the original onto said photosensitive body to form an electrostatic latent image corresponding to the original;

developing means for developing the latent image with toner;

shutter means for shielding light passing through one of a plurality of selected optical exposure paths to said photosensitive body; and control means for controlling a range shielded by said shutter means in accordance with an output from said detection means.

8. An apparatus according to claim 7, wherein said detection means has a plurality of light-receiving elements for receiving light from the original, and means for discriminating the image region and non-image region of the original based on outputs from said light-receiving elements.

9. An apparatus according to claim 8, wherein said correction means comprises calculation means for calculating an inclination of an image based on the output from said light-receiving elements, and image rotating means for rotating an image based on the calculation result of said calculation means.

10. An apparatus according to claim 9, wherein a said image rotating means has a prism and a motor for driving said prism.

11. An image recording apparatus having charge means for uniformly charging a photosensitive body, exposure means for projecting light corresponding to an optical image of an original onto the charged photosensitive body to form an electrostatic latent image, and developing means for developing the latent image with toner, comprising:

detection means for detecting a position of an image of an original;

rotation means for rotating the image around an axis parallel to an optical axis;

drive means for driving said rotation means to correct an inclination of the image based on an output from said detection means;

calculating means for calculating a position of the image for which inclination is to be corrected based on the output from said detection means and an image inclination value to be corrected;

prevention means for preventing toner attachment onto a selected portion of said photosensitive body; and means for controlling said prevention means, in accordance with the output from said calculating means, for controlling the toner attachment portion of the photosensitive body.

12. An image recording apparatus according to claim 11 wherein said calculating means includes means for effecting transformation of coordinates indicating a predetermined range of the image detected by said detection means in which said inclination value is to be corrected.

13. An image recording apparatus according to claim 11 wherein said rotation means includes a prism.

14. An image recording apparatus according to claim 11 wherein said prevention means comprises shutter means for shielding light passing through the image projecting optical path.

15. An image recording apparatus according to claim 14 wherein said rotation means and said shutter means are simultaneously driven.

16. A printer comprising;

projection means for projecting an image on microfilm onto a photosensitive medium;

developing means for developing with a toner a latent image formed on said photosensitive medium based on the projected image;

detection means for detecting an inclination of the image on the microfilm;

rotation means for rotating the image;

correction means for driving said rotation means based on an output from said detecting means to correct the inclination of the image;

prevention means for preventing toner attachment onto the photosensitive medium corresponding to a peripheral portion of the projected image corrected by said correction means.

17. A printer according to claim 16 wherein:

said detection means calculates the inclination of the image by detecting coordinates indicating the predetermined region of the image.

* * * * *

UNITED STATES PATENT AND TRADEMARK OFFICE

CERTIFICATE OF CORRECTION

PATENT NO. : 4,839,696

DATED : June 13, 1989

INVENTOR(S) : KAZUO OHTANI

It is certified that error appears in the above-identified patent and that said Letters Patent is hereby corrected as shown below:

ON THE TITLE PAGE
AT [56] REFERENCES CITED

Under U.S. Patent Documents, insert
--4,745,489 5/1988 Kashiwagi et al. .....355/7X--.

COLUMN 1

Line 28, "image from f" should read --image frame f--.

COLUMN 2

Line 29, "form" should read --from--.

COLUMN 3

Line 20, "broken-line positions 2' and 3"" should read --broken-line positions 2'and 3'--.
Line 45, "and" should read --an--.

COLUMN 5

Line 1, "first" should read --first area--.
Line 9, "printed" should read --prevented--.
Line 60, "$In_2O_3$, films," should read --$In_2O_3$ films,--.

COLUMN 6

Line 3, "form" should read --from--.

UNITED STATES PATENT AND TRADEMARK OFFICE

CERTIFICATE OF CORRECTION

PATENT NO. : 4,839,696

DATED : June 13, 1989

INVENTOR(S) : KAZUO OHTANI

It is certified that error appears in the above-identified patent and that said Letters Patent is hereby corrected as shown below:

COLUMN 7

Line 21, "given" (second occurrence) should read --given as--.

Line 28, "θr, r1, r4 θ1," should read --θr, r1, r4, θ1,--.

Line 32, "$\theta 4=\cos^{-1}(i\ x4/r4)$" should read --$\theta 4=\cos^{-1}(x4/r4)$--.

COLUMN 9

Line 25, "the larger" should read --and larger--.

Line 28, "apparats" should read --apparatus--.

Line 36, "form" should read --from--.

Line 59, "a" should be deleted.

COLUMN 10

Line 41, "comprising;" should read --comprising:--.

Signed and Sealed this

Nineteenth Day of February, 1991

*Attest:*

HARRY F. MANBECK, JR.

*Attesting Officer*

*Commissioner of Patents and Trademarks*